US008573296B2

(12) United States Patent
Levie

(10) Patent No.: US 8,573,296 B2
(45) Date of Patent: Nov. 5, 2013

(54) LIMIT COLLAR

(75) Inventor: Iain Levie, The Woodlands, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 261 days.

(21) Appl. No.: 13/093,242

(22) Filed: Apr. 25, 2011

(65) Prior Publication Data

US 2012/0267121 A1 Oct. 25, 2012

(51) Int. Cl.
*E21B 23/00* (2006.01)

(52) U.S. Cl.
USPC ..... 166/241.1; 166/241.6

(58) Field of Classification Search
USPC ..... 166/380, 382, 241.1, 241.6
See application file for complete search history.

(56) References Cited

U.S. PATENT DOCUMENTS

| | | | |
|---|---|---|---|
| 2,220,237 | A | 11/1940 | Hall |
| 2,228,649 | A | 1/1941 | Welles |
| 2,482,985 | A | 9/1949 | Lockwood |
| 2,904,313 | A | 9/1959 | Wisenbaker |
| 2,998,074 | A | 8/1961 | Casady et al. |
| 3,177,946 | A | 4/1965 | Hall, Sr. |
| 3,209,836 | A | 10/1965 | Hall, Sr. |
| 3,566,965 | A | 3/1971 | Solum |
| 3,852,923 | A | 12/1974 | Hess |
| 4,467,879 | A | 8/1984 | Burge |
| 4,512,425 | A | 4/1985 | Brock |
| 4,785,852 | A | 11/1988 | Okahashi et al. |
| 4,794,986 | A | 1/1989 | Langer |
| 5,027,914 | A | 7/1991 | Wilson |
| 5,097,905 | A | 3/1992 | Goodwin |
| 5,228,509 | A | 7/1993 | Ungemach et al. |
| 5,358,039 | A | 10/1994 | Fordham |
| 5,575,333 | A | 11/1996 | Lirette et al. |
| 5,657,820 | A | 8/1997 | Bailey et al. |
| 5,937,948 | A | 8/1999 | Robbins, III |
| 5,988,276 | A | 11/1999 | Oneal |
| 6,062,326 | A | 5/2000 | Strong et al. |
| 6,065,537 | A | 5/2000 | Evans et al. |
| 6,102,118 | A | 8/2000 | Moore |
| 6,209,638 | B1 | 4/2001 | Mikolajczyk |
| 6,285,014 | B1 | 9/2001 | Beck et al. |
| 6,371,203 | B2 | 4/2002 | Frank et al. |
| 6,401,820 | B1 | 6/2002 | Kirk et al. |

(Continued)

FOREIGN PATENT DOCUMENTS

| | | | |
|---|---|---|---|
| CN | 1837572 | A | 9/2006 |
| CN | 100404784 | C | 7/2008 |

(Continued)

OTHER PUBLICATIONS

Foreign communication from a related counterpart application—International Search Report and Written Opinion, PCT/US2009/055193, May 25, 2010, 10 pages.

(Continued)

*Primary Examiner* — William P Neuder
(74) *Attorney, Agent, or Firm* — John W. Wustenberg; Conley Rose, P.C.

(57) ABSTRACT

A limit collar includes a limit component coupled to a surface of a wellbore tubular; and an interface component engaging the limit component. The interface component may include an extension, and wherein at least one surface of the extension is coupled to the limit component. The extension may also include a side extension.

23 Claims, 10 Drawing Sheets

(56) References Cited

U.S. PATENT DOCUMENTS

| | | | | |
|---|---|---|---|---|
| 6,457,517 | B1 | 10/2002 | Goodson et al. | |
| 6,637,511 | B2 | 10/2003 | Linaker | |
| 6,659,173 | B2 | 12/2003 | Kirk et al. | |
| 6,679,325 | B2 | 1/2004 | Buytaert | |
| 6,997,254 | B2 | 2/2006 | Jenner | |
| 7,231,975 | B2 | 6/2007 | Lavaure et al. | |
| 7,412,761 | B2 | 8/2008 | Male et al. | |
| 7,516,782 | B2 | 4/2009 | Sheiretov et al. | |
| 7,748,476 | B2 | 7/2010 | Krueger | |
| 7,845,061 | B2 * | 12/2010 | Buytaert et al. | 29/557 |
| 7,861,744 | B2 | 1/2011 | Fly et al. | |
| 8,141,627 | B2 | 3/2012 | Krieg et al. | |
| 8,162,050 | B2 | 4/2012 | Roddy et al. | |
| 8,196,670 | B2 | 6/2012 | Jenner | |
| 8,245,777 | B2 | 8/2012 | Garner | |
| 8,281,857 | B2 | 10/2012 | Willberg et al. | |
| 8,291,975 | B2 | 10/2012 | Roddy et al. | |
| 8,297,352 | B2 | 10/2012 | Roddy et al. | |
| 8,297,353 | B2 | 10/2012 | Roddy et al. | |
| 8,302,686 | B2 | 11/2012 | Roddy et al. | |
| 8,316,936 | B2 | 11/2012 | Roddy et al. | |
| 8,360,161 | B2 | 1/2013 | Buytaert et al. | |
| 2001/0037883 | A1 | 11/2001 | Veneruso et al. | |
| 2002/0139537 | A1 | 10/2002 | Young et al. | |
| 2002/0139538 | A1 | 10/2002 | Young et al. | |
| 2005/0224123 | A1 | 10/2005 | Baynham et al. | |
| 2007/0131414 | A1 | 6/2007 | Calderoni et al. | |
| 2008/0035331 | A1 | 2/2008 | Buytaert | |
| 2008/0196900 | A1 | 8/2008 | Leibfried et al. | |
| 2008/0283236 | A1 | 11/2008 | Akers et al. | |
| 2009/0308615 | A1 | 12/2009 | Buytaert | |
| 2010/0218956 | A1 * | 9/2010 | Buytaert et al. | 166/382 |
| 2010/0252274 | A1 | 10/2010 | Buytaert et al. | |
| 2011/0042102 | A1 | 2/2011 | Buytaert | |
| 2011/0146971 | A1 * | 6/2011 | Buytaert et al. | 166/241.6 |
| 2011/0187556 | A1 | 8/2011 | Roddy et al. | |
| 2011/0199228 | A1 | 8/2011 | Roddy et al. | |
| 2012/0145410 | A1 | 6/2012 | Levie | |
| 2012/0145414 | A1 * | 6/2012 | Nutley et al. | 166/387 |
| 2012/0186808 | A1 * | 7/2012 | Lively et al. | 166/241.6 |
| 2012/0186828 | A1 * | 7/2012 | Lively et al. | 166/381 |
| 2012/0267121 | A1 | 10/2012 | Levie | |
| 2013/0068483 | A1 | 3/2013 | Levie et al. | |

FOREIGN PATENT DOCUMENTS

| | | | |
|---|---|---|---|
| DE | 102005040482 | A1 | 3/2007 |
| EP | 1235971 | B1 | 11/2005 |
| GB | 2272925 | A | 6/1994 |
| GB | 2431664 | A | 5/2007 |
| JP | 60166516 | | 8/1985 |
| WO | 0066874 | A1 | 11/2000 |
| WO | 0146550 | A1 | 6/2001 |
| WO | 0202904 | A1 | 1/2002 |
| WO | 0248501 | A1 | 6/2002 |
| WO | 2004015238 | A1 | 2/2004 |
| WO | 2008015402 | A2 | 2/2008 |
| WO | 2008144249 | A2 | 11/2008 |
| WO | 2011025488 | A1 | 3/2011 |
| WO | 2012076850 | A1 | 6/2012 |
| WO | 2012101401 | A2 | 8/2012 |
| WO | 2012101401 | A3 | 8/2012 |
| WO | 2012101402 | A2 | 8/2012 |
| WO | 2012101402 | A3 | 8/2012 |
| WO | 2012146892 | A2 | 11/2012 |

OTHER PUBLICATIONS

Patent application entitled "Integral pull-through centralizer," by Iain Levie, filed Dec. 9, 2010 as U.S. Appl. No. 12/964,605.

Patent application entitled "Composite bow centralizer," by Glenn Lively, et al., filed Jan. 25, 2011 as U.S. Appl. No. 13/013,259.

Patent application entitled "Composite bow centralizer," by Glenn Lively, et al., filed Jan. 25, 2011 as U.S. Appl. No. 13/013,266.

Patent application entitled "Composite Stop Collar," by William Iain Elder Levie, filed Sep. 20, 2011 as U.S. Appl. No. 13/236,987.

"Specifications for bow-spring centralizers," API Specification 10D, Mar. 2002, 6th edition, 24 pages, American Petroleum Institute, Washington, D.C.

Foreign communication from a related counterpart application—International Search Report, PCT/GB2011/001704, May 15, 2012, 5 pages.

Foreign communication from a related counterpart application—International Search Report and Written Opinion, PCT/GB2012/000066, Nov. 22, 2012, 10 pages.

Foreign communication from a related counterpart application—International Search Report and Written Opinion, PCT/GB2012/000067, Nov. 23, 2012, 11 pages.

Office Action dated Feb. 14, 2013 (31 pages), U.S. Appl. No. 12/964,605, filed Dec. 9, 2010.

Office Action dated Mar. 27, 2013 (33 pages), U.S. Appl. No. 13/013,259, filed Jan. 25, 2011.

Office Action dated Apr. 1, 2013 (33 pages), U.S. Appl. No. 13/013,266, filed Jan. 25, 2011.

Foreign communication from a related counterpart application—International Preliminary Report on Patentability, PCT/US2009/055193, Feb. 28, 2012, 6 pages.

Foreign communication from a related counterpart application—International Search Report and Written Opinion, PCT/GB2012/000382, Aug. 9, 2013, 10 pages.

* cited by examiner

LIMIT COLLAR

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations that contain hydrocarbons to allow recovery of the hydrocarbons. Some wellbore servicing methods employ wellbore tubulars that are lowered into the wellbore for various purposes throughout the life of the wellbore. Various components can be disposed on the outer surface of a wellbore tubular to achieve a variety of effects during drilling, completion, and servicing operations. For example, centralizers can be used to maintain the wellbore tubulars aligned within the wellbore since wellbores are not generally perfectly vertical. Alignment may help prevent any friction between the wellbore tubular and the side of the wellbore wall or casing, potentially reducing any damage that may occur. Common components disposed about a wellbore tubular use limit collars, which are also referred to as stop collars or limit clamps, located at either end of the components to maintain the positioning of the component relative to the wellbore tubular as the tubular is conveyed into and out of the wellbore. The various components may be free to move within the limits of the limit collars. Traditional limit collars use one or more set screws passing through a metal stop collar and contacting the wellbore tubular to couple the stop collar to the tubular. The use of set screws provides a limited amount of retaining force, thereby limiting the force the stop collar can support.

SUMMARY

Disclosed herein is a limit collar comprising a limit component coupled to a surface of a wellbore tubular; and an interface component engaging the limit component. An edge of the limit component may be tapered. The interface component may comprise at least one material selected from the group consisting of: a metal, an alloy, a composite, a ceramic, and any combination thereof. The interface component may comprise an extension, where at least one surface of the extension is coupled to the limit component. The extension may comprise a side extension. The extension may comprise a longitudinal extension or a fibrous material. The extension may comprise a surface feature selected from the group consisting of: a protrusion, a recess, a surface corrugation, a surface stippling, and a surface roughening. The limit collar may comprise a plurality of portions, and wherein each portion does not extend around the perimeter of the wellbore tubular. The limit collar may also comprise one or more slots formed between adjacent portions. The limit collar may also include a plurality of interface components engaging the limit component.

Also disclosed herein is a method comprising: providing a limit collar disposed on a wellbore tubular and a first component slidingly engaged on the wellbore tubular, wherein the limit collar comprises: a limit component coupled to a surface of the wellbore tubular; and an interface component engaging the limit component; conveying the wellbore tubular within a wellbore, wherein the first component is retained on the wellbore tubular due to the engagement of the first component with the interface component. The limit component may comprise a material selected from the group consisting of: a composite, a ceramic, a resin, an epoxy, a polymer, a metal, an alloy, or any combination thereof. The limit component may comprise a polymer, and the polymer may comprise a cross-linked polymer, a polyolefin, a cross-linked polyolefin, or any combination thereof. The limit component may comprise a metal, and the metal may be selected from the group consisting of: iron, chromium, nickel, molybdenum, tungsten, titanium, niobium, manganese, silicon, vanadium, combinations thereof, and alloys thereof. The interface component may comprise a material with a compressive strength greater than that of a material used to form the limit component. The interface component may comprise an extension that comprises a shear force transfer surface, and a compressive load transfer surface. The interface component may comprise an extension that comprises a shear force transfer surface, a compressive load transfer surface, and a tensile load transfer surface. The interface component may comprise an extension that comprises a total load transfer surface area, wherein a first portion of the total load transfer surface area comprises a compressive load transfer surface, and wherein a second portion of the total surface area comprises a shear load transfer surface. The limit collar may also include a plurality of interface components engaging the limit component.

Also disclosed herein is a method comprising: providing a wellbore tubular; and forming a limit collar on a first surface portion of the wellbore tubular, wherein the limit collar comprises: a limit component coupled to the first surface portion of the wellbore tubular; and an interface component engaging the limit component. Forming a limit collar on the first surface portion may comprise: disposing a mold about the interface component and the first surface portion; and injecting a composite material into a space between the mold and the first surface portion to form the limit component. Forming a limit collar on the first surface portion may also comprise: disposing a polymer material about the interface component and the first surface portion; and shrinking the polymer material to form the limit collar by applying heat to the polymer. Forming a limit collar on the first surface portion may further comprise: thermally spraying a composition comprising a metal onto the first surface portion and the interface component to form the limit collar.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
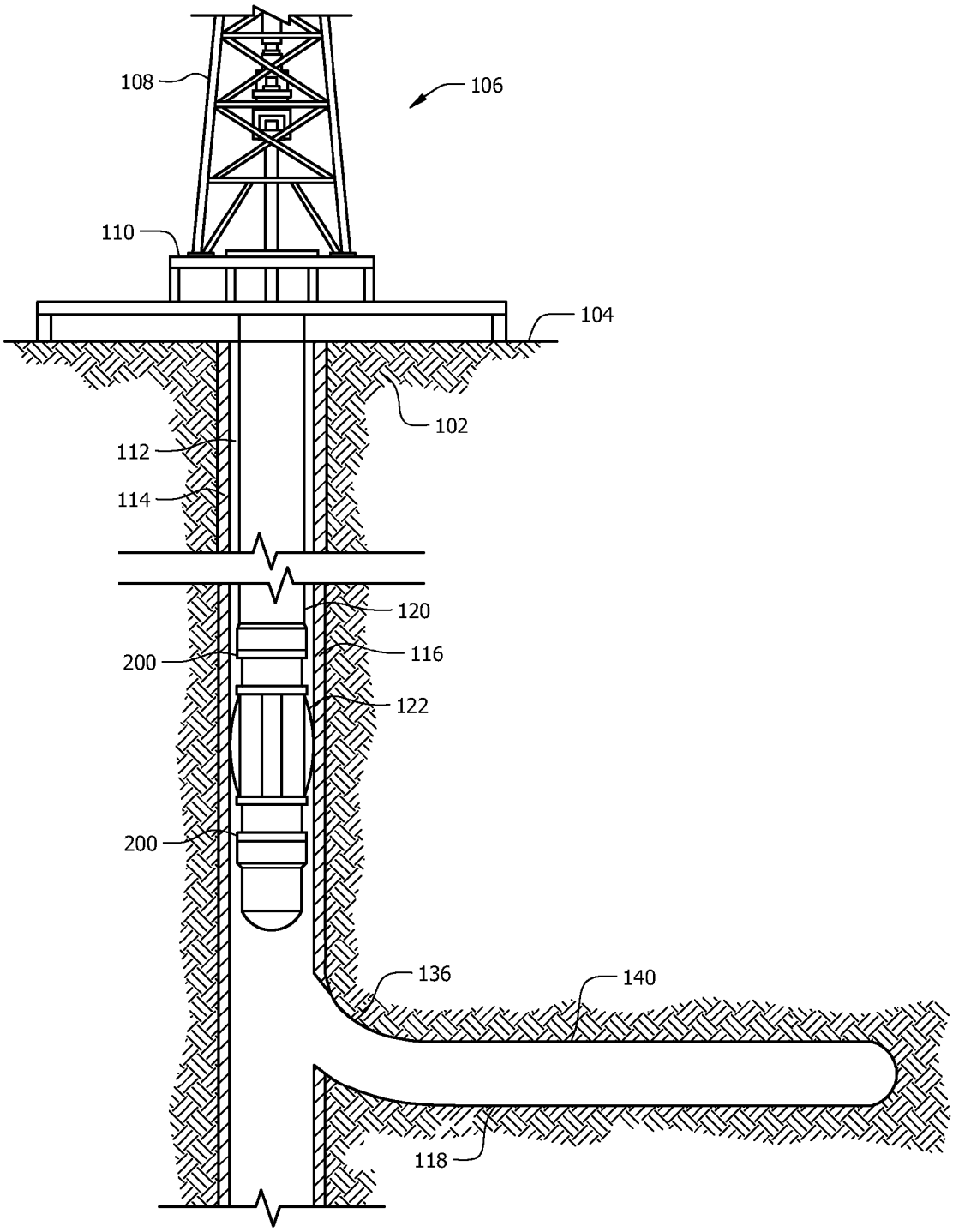
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

Referring to FIG. 1, an example of a wellbore operating environment is shown. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells.

A wellbore tubular string 120 comprising a limit collar 200 may be lowered into the subterranean formation 102 for a variety of workover or treatment procedures throughout the life of the wellbore. The embodiment shown in FIG. 1 illustrates the wellbore tubular 120 in the form of a casing string being lowered into the subterranean formation with the limit collar retaining a centralizer 122. It should be understood that the wellbore tubular 120 comprising a limit collar 200 is equally applicable to any type of wellbore tubular being inserted into a wellbore, including as non-limiting examples drill pipe, production tubing, rod strings, and coiled tubing. The limit collar 200 may also be used to retain one or more components on various other tubular devices and/or downhole tools (e.g., various downhole subs and workover tools). In the embodiment shown in FIG. 1, the wellbore tubular 120 comprising the limit collar 200 is conveyed into the subterranean formation 102 in a conventional manner and may subsequently be secured within the wellbore 114 by filling an annulus 112 between the wellbore tubular 120 and the wellbore 114 with cement.

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the casing string 120 into the wellbore 114 to position the wellbore tubular 120 at a selected depth. While the operating environment depicted in FIG. 1 refers to a stationary drilling rig 106 for lowering and setting the wellbore tubular 120 comprising the limit collar 200 within a land-based wellbore 114, in alternative embodiments, mobile workover rigs, wellbore servicing units (such as coiled tubing units), and the like may be used to lower the wellbore tubular 120 comprising the limit collar 200 into a wellbore. It should be understood that a wellbore tubular 120 comprising the limit collar 200 may alternatively be used in other operational environments, such as within an offshore wellbore operational environment.

In alternative operating environments, a vertical, deviated, or horizontal wellbore portion may be cased and cemented and/or portions of the wellbore may be uncased. For example, uncased section 140 may comprise a section of the wellbore 114 ready for being cased with wellbore tubular 120. In an embodiment, a limit collar 200 may be used on production tubing in a cased or uncased wellbore. In an embodiment, a portion of the wellbore 114 may comprise an underreamed section. As used herein, underreaming refers to the enlargement of an existing wellbore below an existing section, which may be cased in some embodiments. An underreamed section may have a larger diameter than a section upward from the underreamed section. Thus, a wellbore tubular passing down through the wellbore may pass through a smaller diameter passage followed by a larger diameter passage.

Regardless of the type of operational environment in which the limit collar 200 is used, it will be appreciated that the limit collar 200 serves to limit the longitudinal movement and/or retain one or more components disposed about a wellbore tubular. In an embodiment, a plurality of limit collars 200 may be used to limit and/or retain one or more components about a wellbore tubular. In an embodiment, the limit collar 200 may serve as a guide or centralizer without the aid of any additional components. As described in greater detail below with respect to FIG. 2, the limit collar 200 comprises a limit component 202 that engages an interface component 204, both of which are disposed on a wellbore tubular 206. In an embodiment, the limit collar 200 may comprise a plurality of interface components 204 disposed at the ends of the limit collar 200 and engaging an interface component 204 between the interface components 204. In an embodiment, the limit collar 200 described herein may be used to retain one or more components on the wellbore tubular 120 as the one or more components are passed through close tolerance restrictions within the wellbore 114. In an embodiment, the limit collar 200 described herein may be used in close tolerance wellbores through which traditional stop collars would not pass.

Figure 2:
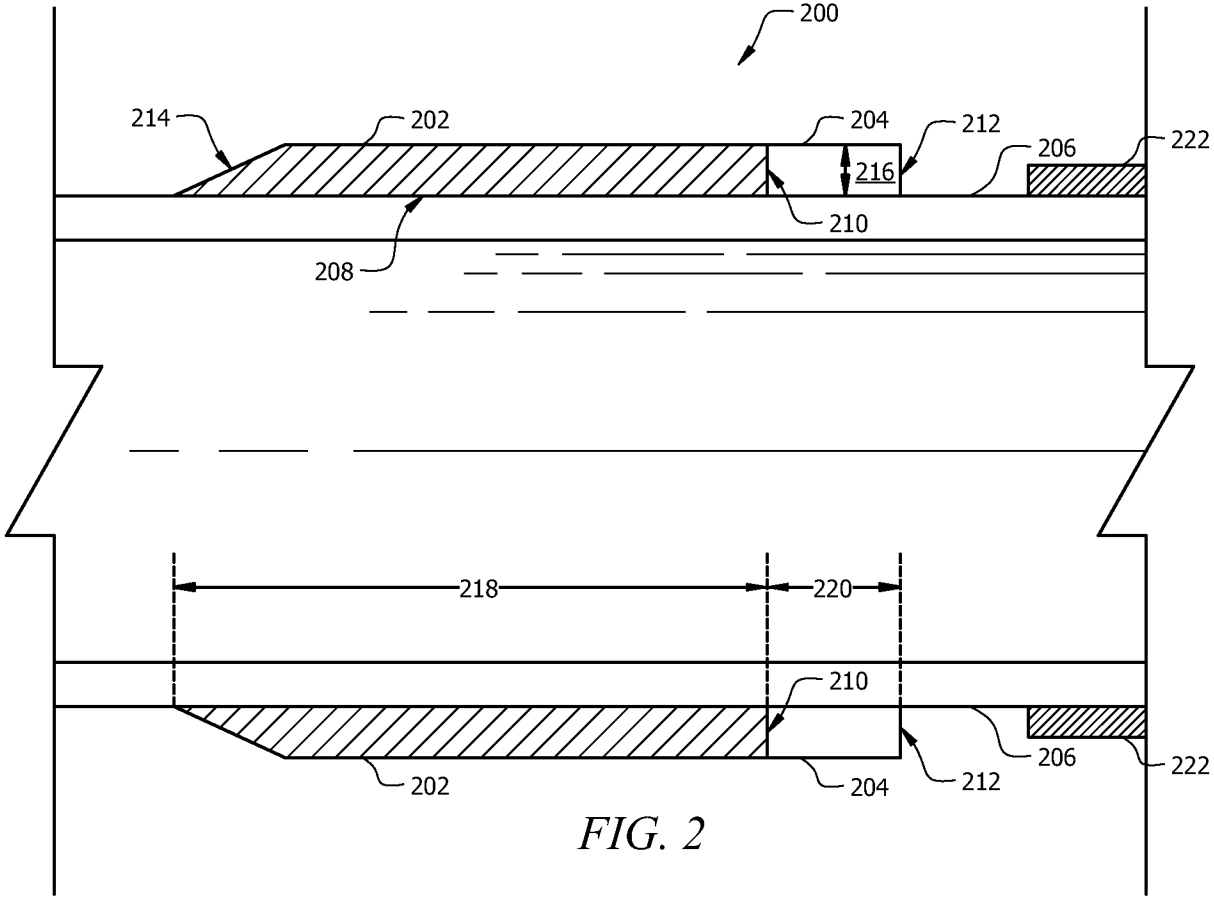
FIG. 2 is a cross-sectional view of a limit collar according to an embodiment.

Referring now to FIG. 2, an embodiment of the limit collar 200 disposed on a wellbore tubular 206 is shown in cross-section. As described above, the limit collar 200 comprises a limit component 202 that engages an interface component 204. The limit component 202 may generally comprise a material that engages, couples, and/or bonds to the wellbore tubular 206. In an embodiment, the limit component 202 may provide the majority of the retaining force exhibited by the limit collar 200. The interface component 204 may engage the limit component 202 and prevent point loading of an applied force directly to the limit component 202. By distributing a load applied to the limit component 202 through the interface component 204, point loading and the resulting potential failure of the limit component 202 may be reduced or avoided, thereby improving the load capacity of the limit collar 200.

The limit component 202 can comprise any material that engages, couples, and/or bonds to the wellbore tubular 206 via the formation of a chemical and/or mechanical bond. In an embodiment, the limit component 202 may bond to the wellbore tubular 206 over the contact area 208 between the limit component 202 and the wellbore tubular 206. In an embodiment, the limit component 202 may include, but is not limited to, a composite, a ceramic, a resin, an epoxy, a polymer, a metal, an alloy, or any combination thereof. The limit component 202 may be disposed and/or bonded to the wellbore tubular 206 using any known techniques for applying the desired material. For example, a flame spray method, sputtering, welding, brazing, diffusion bonding, casting, molding, curing, or any combination thereof may be used to apply the limit component 202 to the wellbore tubular 206, as discussed in more detail below. The limit component 202 may generally be disposed and/or bonded to the wellbore tubular 206 as a generally cylindrical layer, though the shape of the limit component 202 may vary based, at least in part, on the shape of the wellbore tubular 206. In an embodiment, the limit collar 200 comprising the limit component 202 may be disposed and/or bonded to the wellbore tubular 206 as one or more portions or patches that may provide one or more longitudinal slots or flow channels, as described in more detail below. Additional suitable shapes of the limit component 202 are discussed in more detail below. In an embodiment, the edges 214 of the limit component 202 may be tapered or angled to aid in movement of the limit collar 200 through the wellbore (e.g., through a close tolerance restriction). In an embodiment, tapered or angled edge 214 is a leading edge in a direction of travel of the wellbore tubular 206 within the wellbore (e.g., a downhole leading edge as the tubular is being run into a wellbore).

The limit component 202 of the limit collar 200 may comprise one or more composite materials. A composite material comprises a heterogeneous combination of two or more components that differ in form or composition on a macroscopic scale. While the composite material may exhibit characteristics that neither component possesses alone, the components retain their unique physical and chemical identities within the composite. Composite materials may include a reinforcing agent and a matrix material. In a fiber-based composite, fibers may act as the reinforcing agent. The matrix material may act to keep the fibers in a desired location and orientation and also serve as a load-transfer medium between fibers within the composite. The matrix material may also act to bond the composite material to the surface of the wellbore tubular 206, thereby forming the chemical and/or mechanical bond between the limit component 202 and the wellbore tubular 206.

The matrix material may comprise a resin component, which may be used to form a resin matrix. Suitable resin matrix materials that may be used in the composite materials described herein may include, but are not limited to, thermosetting resins including orthophthalic polyesters, isophthalic polyesters, phthalic/maelic type polyesters, vinyl esters, thermosetting epoxies, phenolics, cyanates, bismaleimides, nadic end-capped polyimides (e.g., PMR-15), and any combinations thereof. Additional resin matrix materials may include thermoplastic resins including polysulfones, polyamides, polycarbonates, polyphenylene oxides, polysulfides, polyether ether ketones, polyether sulfones, polyamide-imides, polyetherimides, polyimides, polyarylates, liquid crystalline polyester, polyurethanes, polyureas, and any combinations thereof.

In an embodiment, the matrix material may comprise a two-component resin composition. Suitable two-component resin materials may include a hardenable resin and a hardening agent that, when combined, react to form a cured resin matrix material. Suitable hardenable resins that may be used include, but are not limited to, organic resins such as bisphenol A diglycidyl ether resins, butoxymethyl butyl glycidyl ether resins, bisphenol A-epichlorohydrin resins, bisphenol F resins, polyepoxide resins, novolak resins, polyester resins, phenol-aldehyde resins, urea-aldehyde resins, furan resins, urethane resins, glycidyl ether resins, other epoxide resins, and any combinations thereof. Suitable hardening agents that can be used include, but are not limited to, cyclo-aliphatic amines; aromatic amines; aliphatic amines; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; indazole; amines; polyamines; amides; polyamides; 2-ethyl-4-methyl imidazole; and any combinations thereof. In an embodiment, one or more additional components may be added the matrix material to affect the properties of the matrix material. For example, one or more elastomeric components (e.g., nitrile rubber) may be added to increase the flexibility of the resulting matrix material.

The fibers may lend their characteristic properties, including their strength-related properties, to the composite. Fibers useful in the composite materials used to form the limit component 202 of the limit collar 200 may include, but are not limited to, glass fibers (e.g., e-glass, A-glass, E-CR-glass, C-glass, D-glass, R-glass, and/or S-glass), cellulosic fibers (e.g., viscose rayon, cotton, etc.), carbon fibers, graphite fibers, metal fibers (e.g., steel, aluminum, etc.), ceramic fibers, metallic-ceramic fibers, aramid fibers, and any combinations thereof.

The strength of the interface between the fibers and the matrix material may be modified or enhanced through the use of a surface coating agent. The surface coating agent may provide a physico-chemical link between the fiber and the resin matrix material, and thus may have an impact on the mechanical and chemical properties of the final composite. The surface coating agent may be applied to fibers during their manufacture or any other time prior to the formation of the composite material. Suitable surface coating agents may include, but are not limited to, surfactants, anti-static agents, lubricants, silazane, siloxanes, alkoxysilanes, aminosilanes, silanes, silanols, polyvinyl alcohol, and any combinations thereof.

In an embodiment, the limit component 202 may comprise a ceramic based resin including, but not limited to, the types disclosed in U.S. Patent Application Publication Nos. US 2005/0224123 A1, entitled "Integral Centraliser" and published on Oct. 13, 2005, and US 2007/0131414 A1, entitled "Method for Making Centralizers for Centralising a Tight Fitting Casing in a Borehole" and published on Jun. 14, 2007, both of which are incorporated herein by reference in their entirety. For example, in some embodiments, the resin material may include bonding agents such as an adhesive or other curable components. In some embodiments, components to be mixed with the resin material may include a hardener, an accelerator, or a curing initiator. Further, in some embodiments, a ceramic based resin composite material may comprise a catalyst to initiate curing of the ceramic based resin composite material. The catalyst may be thermally activated. Alternatively, the mixed materials of the composite material may be chemically activated by a curing initiator. More specifically, in some embodiments, the composite material may comprise a curable resin and ceramic particulate filler materials, optionally including chopped carbon fiber materials. In some embodiments, a compound of resins may be characterized by a high mechanical resistance, a high degree of surface adhesion and resistance to abrasion by friction.

In an embodiment, the limit component 202 of the limit collar 200 may comprise a polymer. The polymer may be provided in the form of a tape, wrap, sleeve, sheet, fiber, and/or a fibrous material that can be disposed about the wellbore tubular 206. The polymer may comprise a cross-linked polymer, a polyolefin, a cross-linked polyolefin, any combination thereof. The use of a cross-linked polymer such as a cross-linked polyolefin may allow the cross-linked polymer to shrink upon the application of heat. The cross-linking may be imparted to the polymer through any method known in the art including, but not limited to, irradiation and/or the incorporation of chemical cross-linking agents.

In an embodiment, the polymer comprises a polyolefin and/or cross-linked polyolefin that, in an embodiment, may shrink upon heating. As used herein, the term polyolefin generally describes a polymer produced from a simple olefin, such as an alkene with the general formula $C_nH_{2n}$, as a monomer. A polyolefin may include, but is not limited to, polyethylene, polypropylene, any combination thereof, and any blend thereof. Polypropylene may include polymers with various molecular weights, densities, and tacticities synthesized from propylene monomers. Polyethylene may include polymers made through a polymerization of ethylene. For example, polyethylene may include polymers of ethylene polymerized through a free radical polymerization. For example, polyethylene may have a high degree of short and long chain branching. Polyethylene may also include copolymers of ethylene and an alpha olefin comonomer made through a single site catalyzed reaction (e.g., through a metallocene catalyzed reaction) or a blend thereof with an elastomer or high pressure low density polyethylene. Polyethylene may include copolymers made with various alpha olefin monomers including 1-butene, 3-methyl-1-butene, 3-methyl-1-pentene, 1-hexene, 4-methyl-1-pentene, 3-methyl-1-hexene, 1-octene or 1-decene. While specific polymer compositions are referred to herein, one of ordinary skill in the art will appreciate that polymers or polymer blends with substantially equivalent physical properties could be substituted, yet remain within the scope and spirit of the present disclosure.

In an embodiment, an adhesive may be used with the polymer to aid in bonding the polymer to the wellbore tubular. As used herein, the term adhesive includes those materials known in the art as adhesives. The adhesive may include, but it not limited to, compatible mastics, hot-melt polymers, epoxies, polyurethanes, polyimides, synthetic rubbers, or other suitable adhesive materials. The adhesive may be disposed as a layer between the polymer and the wellbore tubular 206 and may aid in long-term bonding of the polymer to the wellbore tubular 206.

In an embodiment, the limit component 202 of the limit collar 200 may be formed from one or more metals and/or alloys, and in some embodiments may be formed as a composite material with a matrix phase comprising one or more metals and/or alloys. Suitable metals may include, but are not limited to, iron, chromium, nickel, molybdenum, tungsten, titanium, niobium, manganese, silicon, vanadium, combinations thereof, and alloys thereof. Additional suitable materials may be included in the one or more metals and/or alloys including carbon, boron, and various ceramics. In an embodiment, the limit component 202 may comprise a carbon/boron/chromium steel matrix containing particulates of chromium carbides and borides, and can include additional alloying elements acting as matrix strengtheners, such as nickel, molybdenum, tungsten, and titanium. In an embodiment, the limit component 202 may comprise a metal component having a composition comprising iron and a carbon content of from about 0.40 to about 2.5 weight percent (wt. %); a chromium content of from about 4.0 to about 35 wt. %; a boron content of from about 3.5 to about 10.0 wt. %; a nickel content of from about 0.0 to about 2.0 wt. %; a niobium content of from about 0.0 to about 2.5 wt. %; a manganese content of from about 1.0 to about 3.5 wt. %; a silicon content of from about 0.0 to about 2.5 wt. %; a titanium content of from about 0.0 to about 2.0 wt. %; a vanadium content of from about 0.0 to about 2.0 wt. %; and a tungsten content of from about 0.0 to about 2.5 wt. %. Iron (Fe) comprises the remaining element for the weight balance listed above. A zero percent for the lower weight range indicates a percentage where no intended addition of the element would be present, although some trace amounts may be detected. The composition may have a range of microstructures including, but not limited to, martensitic with a relatively high density of carbides and borides, hypereutectic carbides or borides in a eutectic matrix, and combinations thereof.

The length 218 of the limit component 202 may be chosen to provide a sufficient retaining force for the limit collar 200. When the limit component 202 is disposed and/or bonded to the wellbore tubular 206, a mechanical and/or chemical bond may be formed over the surface 208. Accordingly, the length 218 may be chosen to provide a surface area over which the mechanical and/or chemical bond can act to provide a total retaining force at or above a desired level. In an embodiment, the total retaining force may meet or exceed a load rating or specification for the limit collar 200. The surface area over which the mechanical and/or chemical bond can act may be determined at least in part based on the length 218 and the diameter of the wellbore tubular 206 at the surface 208. Any surface treatments of the wellbore tubular 206 and/or the interface component 204 may be considered when determining the length 218 of the limit component 202 and/or the mechanical and/or chemical bonding strength at the surface 208.

The interface component 204 generally acts as a force transfer element or means between a component 222 being retained on the wellbore tubular 206 and the limit component 202. In the absence of the interface component 204, the limit component 202 may be subject to failure due to point loading of the limit component 202. As used herein, the term "point loading" may refer to the application of a force to a component over less than 20% of the surface area available for loading. With respect to a compression force applied in a longitudinal direction along the wellbore tubular 206, the surface available for loading on the limit component 202 may correspond to the cross-sectional area of the surface 210 in a plane normal to the longitudinal axis of the wellbore tubular 206. The failure of the limit component 202 under point loading conditions in the absence of an interface component 204 may result when the compressive strength of the limit component 202 is exceeded at the loading point and/or area before the shear strength of the chemical and/or mechanical bond formed at the surface 208 between the limit component 202 and the wellbore tubular 206 is reached. The use of an interface component 204 to reduce or eliminate point loading on the limit component 202 may allow the limit collar 200 to support and/or resist higher forces or loads without failing. In an embodiment, the interface component 204 may provide a contact area for applying a load over at least about 70%, alternatively at least about 80%, alternatively at least about 90%, alternatively at least about 95% of the surface area of surface 210. In an embodiment, the interface component 204 may provide a contact area over substantially all of the surface area of surface 210.

In an embodiment, the use of the interface component 204 may allow the limit collar 200 to support and/or resist higher forces or loads without failing as compared to the use of the limit component 202 without an interface component 204. In an embodiment, the limit collar 200 comprising the interface component 204 can withstand an applied load or force at least 20%, 40%, 60%, 80%, or 100% greater than the load or force that can be retained using a limit collar without the interface component 204 (e.g., using the limit component 202 alone).

The interface component 204 may comprise any material having a suitable compressive strength for resisting failure due to point loading from a component 222 applying a force (e.g., a compressive or tensile force) to the interface component 204. In an embodiment the interface component 204 may have a compressive strength greater than the compressive strength of the material or materials forming the limit component 202. In an embodiment, the interface component 204 may comprise a more ductile material than the material or materials forming the limit component 202. An increased ductility may allow the interface component 204 to deform to some degree in response to a point load, thereby increasing the contact area and lessening the pressure applied on the surface 212 between the interface component 204 and a component 222 being retained on the wellbore tubular 206. An increased ductility may also allow the interface component 204 to deform to some degree in response to a point load, thereby increasing the contact area and lessening the pressure applied on the surface 210 between the interface component 204 and the limit component 202. In an embodiment, the interface component 204 may be formed of a material suitable for machining. For example, the interface component may have threads or other connection means formed therein. Suitable materials for forming the interface component may include, but are not limited to, metals (e.g., steel, aluminum, etc.), alloys (e.g., alloys containing steel and/or aluminum), composites (e.g., composites containing steel and/or aluminum, polymer composites, resin composites, carbon fiber composites, etc.), ceramics, any combinations thereof, and other suitable high-strength materials. In an embodiment, the interface component 204 may have a suitable compressive strength to support a compressive load of greater than about 50,000 pounds-force ($lb_f$), 60,000 $lb_f$, about 75,000 $lb_f$, about 100,000 $lb_f$, about 125,000 $lb_f$, or alternatively about 150,000 $lb_f$. The ability of the interface component 204 to support a compressive load may depend on the compressive strength of the material or materials forming the interface component 204 along with the geometry of the interface component 204 (e.g., the cross-sectional area over which the force is applied).

The length 220 of the interface component 204 may be chosen to provide a sufficient load distribution over the limit component 202. When a force is applied to the interface component 204, the force may be transmitted through the interface component 204 to the limit component 202. The length 220 of the interface component 204 may, at least in part, affect the mechanical properties of the interface component 204. For example, the length 220 may affect the deflection of the interface component 204 when a point load is applied to the surface 212 of the interface component 204. The resulting deflection may then apply a non-uniform load to the limit component 202. The choice of the length 220 of the interface component 204 may depend, at least in part, on the material or materials forming the interface component 204, the thickness 216 of the interface component 216, the material or materials forming the limit component 202, the shape and orientation of the interface 210, and the shape and orientation of the interface 212.

The surface 212 may take any shape capable of providing a contact area for applying a load over the interface component 204 when a component 222 to be retained on the wellbore tubular 206 engages the interface component 204. In an embodiment, the surface 212 may comprise a substantially planar surface. In an embodiment, the planar surface may be aligned with a plane normal to the longitudinal axis of the wellbore tubular 206. This alignment may allow for the application of a force from one or more components 222 retained on the wellbore tubular 206 to the interface component 204 in a substantially longitudinal direction. In an embodiment, an edge of a component engaging the surface 212 on the interface component may have a substantially planar surface. The interaction between the two planar surfaces may provide a relatively uniform loading on the interface component 204. In an embodiment, the surface 212 may take on other shapes. In an embodiment, the surface 212 may comprise a complementary and/or mirror surface to the surface of the component 222 that can engage surface 212. In an embodiment, the surface 212 may comprise a locking and/or mating surface with respect to the surface of the component 222 that can engage surface 212. For example, one or more slots, recesses, protrusions, or other alignment means may be formed in the surface 212, and corresponding features may be formed on the surface of component 222 that can engage surface 212. Such structures may aid in aligning a component, which may comprise corresponding features on the interacting surface, with the interface component 204.

The interface 210 between the limit component 202 and the interface component 204 may take any shape capable of providing a contact area for applying a load over the cross-sectional area of the limit component 202. In an embodiment, the interface 210 may comprise a substantially planar interface. In an embodiment, the planar interface may be aligned with a plane normal to the longitudinal axis of the wellbore tubular 206. This alignment may allow for the application of a force from the interface component 204 to the limit component 202 in a substantially longitudinal direction. In an embodiment, the interface 210 may have an irregular shape. In an embodiment, the surface of the limit component 202 at the interface 210 may comprise a complementary and/or mirror surface to the surface of the interface component 204 at the interface 210. In an embodiment, the surface of the limit component 202 at the interface 210 may comprise a locking and/or mating surface to the surface of the interface component 204 at the interface 210. In an embodiment, the interface component 204 and the limit component 202 may have the same thickness 216. In other embodiments, the interface component 204 and the limit component 202 may have different thicknesses. When the interface component 204 and the limit component 202 have different thicknesses, an edge of the limit component 202 and/or an edge of the interface component 204 may be beveled, sloped, or otherwise shaped to provide for a smooth and/or rounded interface between the interface component 204 and the limit component 202.

In an embodiment, the interface component 204 may comprise one or more extensions 302. The one or more extensions 302 may provide structure strength to the limit collar 200 and/or aid in the distribution of the applied force along the length of the limit component 202. In an embodiment, the extension 302 may be disposed with one surface in contact with the wellbore tubular 206 so that the limit component is not disposed between the extension 302 and the wellbore tubular 206. In an embodiment, the extension 302 may be disposed with one surface on the outermost surface of the limit component 202 so that the limit component 202 is disposed entirely between the extension 302 and the wellbore tubular 206. In an embodiment as illustrated in the cross-sectional view of FIG. 3, the extension 302 may be disposed within the limit component so that at least two surfaces 304, 306 are in contact with the limit component 202. While the remaining discussion may refer to the embodiment illustrated in FIG. 3, the concepts applicable when the extension 302 has two surfaces 304, 306 in contact with the limit component 202, may also apply when only one of the surfaces 304, 306 is in contact with the limit component 202.

The limit component 202 may form a mechanical and/or chemical bond with one or more surface 304, 306, 308 of the extension 302 disposed in the limit component 202. The surfaces 304, 306 may generally extend in a longitudinal direction (e.g., generally parallel to the surface of the wellbore tubular). In an embodiment, surfaces 304, 306 may not be parallel to the surface of the wellbore tubular 206, but rather may extend at any angle that still allows surface 304 and/or surface 306 to remain in contact with the limit component 202. Surface 308 may generally extend in a radial direction (e.g., generally perpendicular to the surface of the wellbore tubular 206). In an embodiment, the surface 308 may not be perpendicular to the surface of the wellbore tubular 206, but rather may extend at any angle and/or be curved (e.g., rounded), angled, or otherwise shaped. When a longitudinal load is applied to the interface component 204, the surfaces 304, 306 may generally transfer the applied force to the limit component 202 through the application of a shear force over the surfaces 302, 304. In the same way, the surface 308 may generally transfer an applied force to the limit component 202 through the application of a compressive and or tensile force over the surface 308 when a longitudinal load is applied to the interface component 204. Based on the types of load transfer surfaces, the extension 302 may be described as comprising at least one shear force transfer surface and at least one compressive and/or tensile load transfer surface. In an embodiment, a single angled and/or curved surface may comprise a shear force transfer surface section and a compressive and/or tensile load transfer surface section. In an embodiment, the shape, available contact area, and material selection of the extension 302 and the limit component 202 may be chosen to provide a desired load profile over the length of the limit component 202.

In an embodiment, the interface component 204 and the one or more extensions 302 may comprise a single integral component. For example, the interface component 204 with the one or more extensions 302 may be a machined component formed from a single piece of machinable material (e.g., a metal such as aluminum). In an embodiment, the one or more extensions 302 may be separate components that may be coupled to the interface component 204 prior to or during disposition of the interface component 204 on the wellbore tubular 206.

Figure 4A:
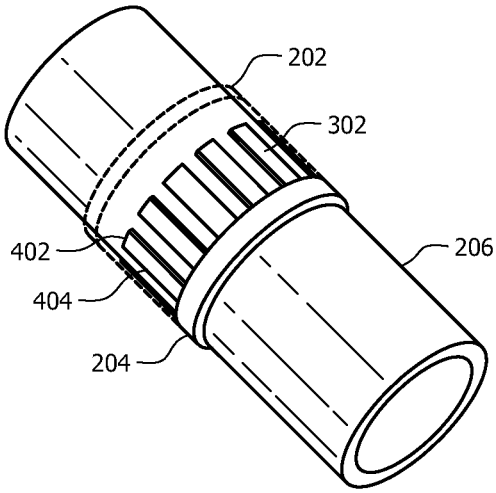
FIGS. 4A-4E are isometric views of a limit collar according to still other embodiments.
Figure 4B:
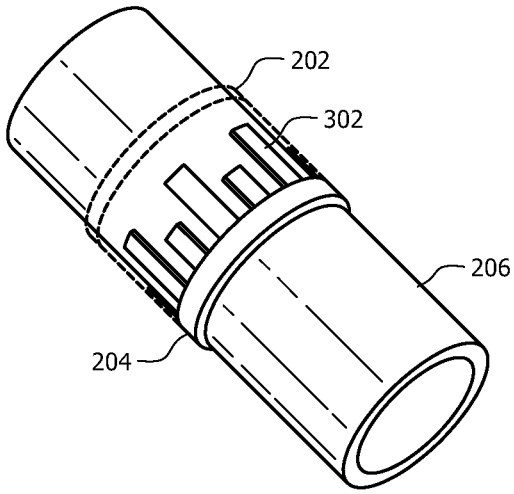

As shown in FIGS. 4A through 4E, the extension 302 can comprise various shapes. The limit component 202 is shown in dashed lines in FIGS. 4A through 4E to better illustrate the extension 302. As shown in FIG. 4A, the extension 302 may take the form of one or more longitudinal extensions. The extensions 302 may be generally rectangular, though the end 402 and the edge 404 may be curved, rounded, smoothed, and/or comprise one or more features for engaging the limit component 202. Suitable features for engaging the limit component 202 may include, but are not limited to, one or more protrusions, recesses, and/or surface roughening on a macroscopic and/or microscopic scale. As shown in FIG. 4B, when a plurality of extensions 302 are present, each extension may be the same length or the extensions 302 may have different lengths. While the extensions 302 of FIG. 4B are illustrated with two alternating lengths, any number of different lengths may be used, and the lengths of adjacent extensions 302 may be varied or be approximately the same.

Figure 4C:
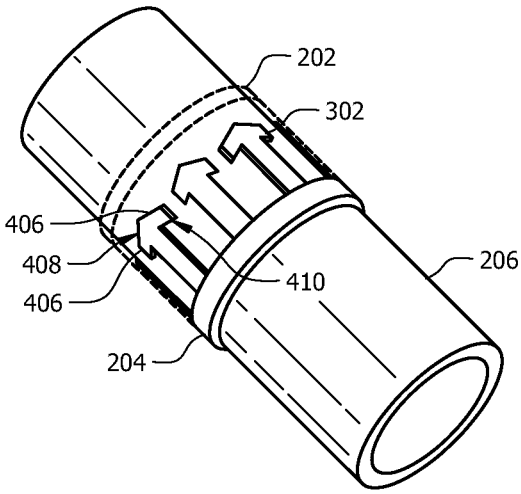

As shown in FIG. 4C, the extensions 302 may comprise shapes other than rectangular. As an example, the extensions 302 may comprise one or more side extensions 406. In an embodiment, the extensions 302 may be arrow shaped, T-shaped, L-shaped, J-shaped or any other shapes with one or more side extensions 406. The side extensions 406 may provide a plurality of compressive and/or tensile load transfer surfaces. For example, surfaces 408, 410 may act to transfer compressive and/or tensile loads from the interface component 204 through the extension 302 and the side extension 406, to the limit component 202. When a longitudinal compressive load (i.e., a load from the interface component into the limit component) is placed on the interface component 204, surface 408 may be in compression while surface 410 may be in tension. Conversely, when a longitudinal tensile load (i.e., a load from the interface component pulling away from the limit component) is placed on the interface component 204, surface 410 may be in tension while surface 410 may be in compression. In an embodiment, the extension 302, which may comprise a side extension 406, may be described as comprising at least one shear force transfer surface and at least one compression load transfer surface whether a compressive or tensile load is placed on the interface component 204. The ability of the limit collar to resist tensile or compressive loads may allow the interface component to be used as a connection point for one or more components, for example using a threaded connection, which may represent an advantage over other types of stop collars. In an embodiment, the extension 302, which may comprise a side extension 406, may be described as comprising at least one shear force transfer surface, at least one compression load transfer surface, and at least one tensile load transfer surface.

Figure 4D:
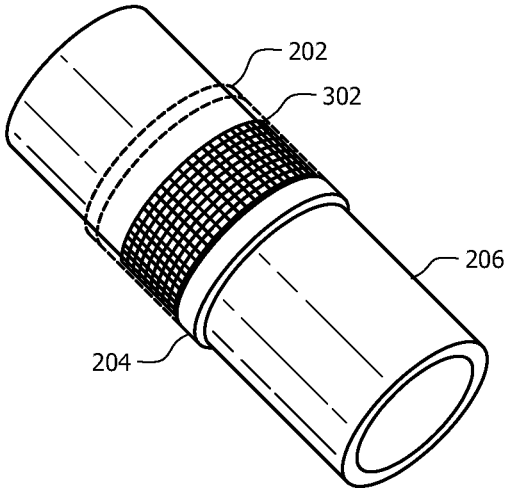

As shown in FIG. 4D, the extension 302 may comprise a mesh, screen, woven material, non-woven fabric, tape, mat, fabric, ply, any multi-filament material, and any fiberous material that can be supplied in the form of tows, rovings, fabrics, and the like (collectively referred to as "fibrous materials"). The use of a fibrous material as a portion or all of the extension 302 may allow for the combination of the extension 302 and the limit component 202 to form a composite material. As described in more detail above, composite materials may include a reinforcing agent and a matrix material. In an embodiment, the limit component 202 may act as the matrix material while the extension comprising a fibrous material may act as the reinforcing agent. The use of a fibrous material may act to both bond and transfer a load from the interface component 204 to the limit component 202 while also strengthening the composite material formed from the combination of the limit component 202 and the extension 302 comprising the fibrous material. The limit component 202 may form a chemical and/or mechanical bond between the limit component 202 and the extension 302 comprising the fibrous material, where the extension comprising a fibrous material may provide a plurality of compressive and/or tensile load transfer surfaces. The plurality of fibers or filaments may have a distribution of surface orientations and/or surface features. In an embodiment, the use of an extension comprising a fibrous material may be described as comprising a total load transfer surface area, where a portion of the total load transfer surface area comprises a compressive and/or tensile load transfer surface and a portion of the total surface area comprises a shear load transfer surface.

Figure 4E:
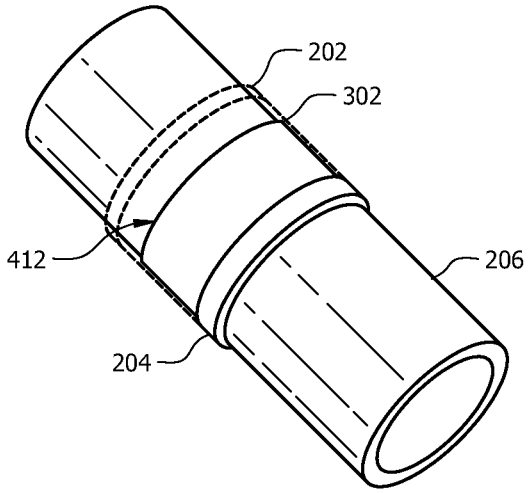

As shown in FIG. 4E, the extension 302 may comprise a single component rather than a plurality of longitudinal extensions. In this embodiment, the single extension may extend around the circumference of the wellbore tubular 206, or may extent only around a portion of the wellbore tubular 206. In an embodiment, the length of the extension 302 may be uniform about the circumference of the wellbore tubular 206 so that the edge 412 of the extension 302 may be in a plane normal to the longitudinal axis of the wellbore tubular 206. In an embodiment, the length of the extension 302 may vary, allowing for the edge 412 to be configured in various patterns (e.g., sawtooth, scalloped, feathered, randomly oriented, etc.). In an embodiment, the extension 302 may comprise various surface features such as recesses and/or protrusions oriented longitudinally, radially, a combination of the two (e.g., spiral, helical), and/or any random orientations.

Figure 5A:
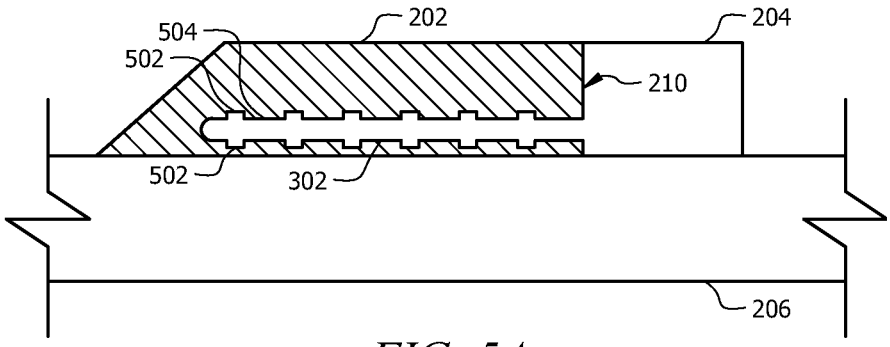
FIGS. 5A and 5B are cross-sectional views of a limit collar according to yet other embodiments.
Figure 5B:
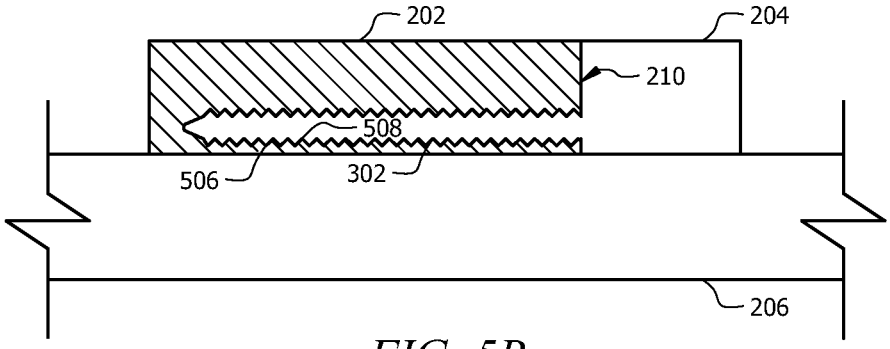

As shown in FIGS. 5A and 5B, the extension 302 may comprise one or more surface features. In an embodiment, the one or more surface features may be used with any of the extensions shown in FIGS. 4A through 4E, including one or more of the components of the fibrous material shown in FIG. 4D. The use of surface features may aid in increasing the surface area for bonding between the extension 302 and the limit component 202. In an embodiment, one or more of the surface features may provide additional force transfer surface area. In an embodiment, the one or more surface features may be described as providing an additional shear force transfer surface and/or an additional compressive and/or tensile load transfer surface. As shown in FIG. 5A, the surface features may comprise a protrusion 502 and/or a recess 504. Any types of protrusions 502 and/or recesses 504 may be used in any orientation with respect to the extension 302, for example square or rectangular protrusions and/or recesses. As shown in FIG. 5B, the protrusions 506 and/or recesses 508 may comprise a saw-tooth pattern. Additional surface features may be used with the extension 302 and/or the surface 210, including for example, corrugation, stippling, roughening, or the like, each on a microscopic and/or macroscopic scale.

Figure 6:
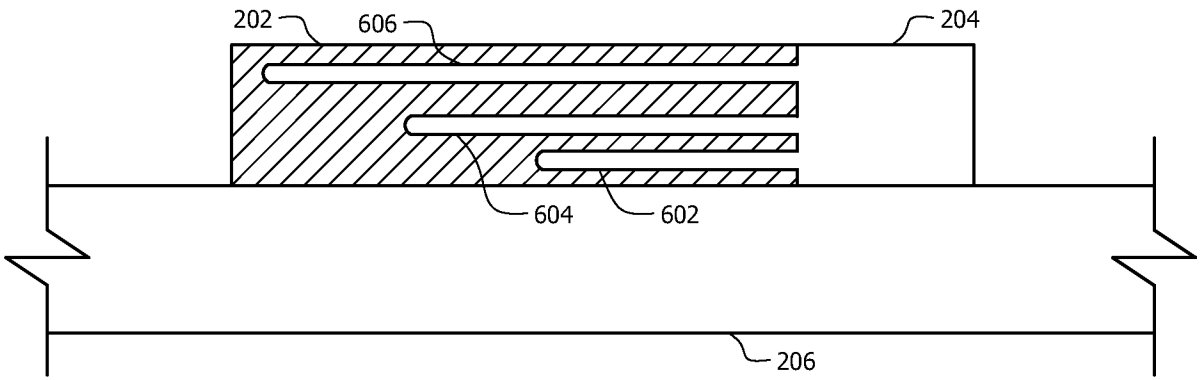
FIG. 6 is a cross-sectional view of a limit collar according to another embodiment.

In an embodiment shown in FIG. 6, a plurality of extensions 602, 604, 606 may be used at various radial distances. The extensions 602, 604, 606 may represent overlapping portions of various extensions. While three extensions 602, 604, 606 are shown in FIG. 6, any number of extensions (e.g., two, three, four, five, or more) may be used. The use of radially overlapping extensions may be applied to any of the embodiments described herein. The plurality of extensions may incorporate any of the various features shown herein, including but not limited to the features shown in FIGS. 2-5.

Figure 7A:
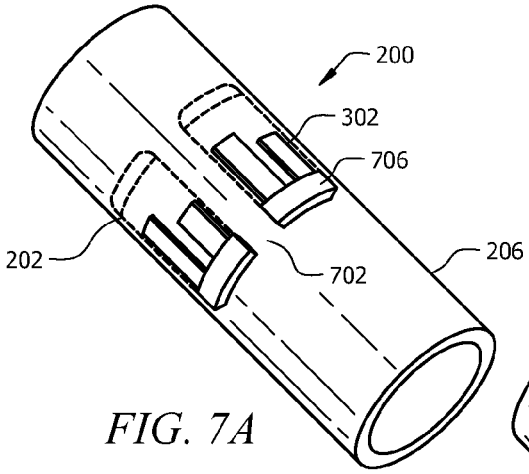
FIGS. 7A-7D are isometric views of a limit collar according to yet other embodiments.
Figure 7B:
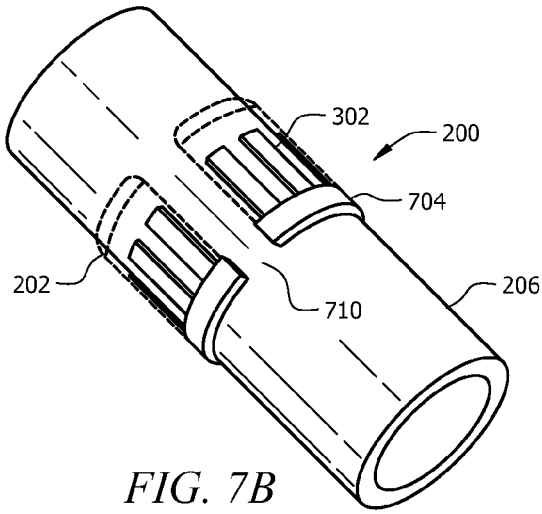
Figure 7C:
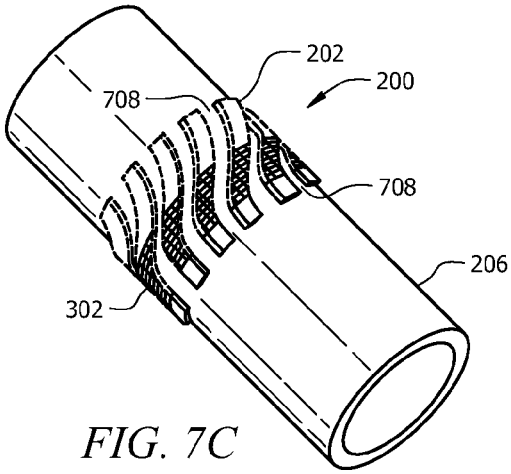

In an embodiment shown in FIGS. 7A through 7C, the limit collar 200 may comprise one or more portions that may not extend around the entire perimeter of the wellbore tubular 206. As shown in FIG. 7A, the limit collar 200 may comprise a plurality of patches, where each patch comprises an interface component 706, a limit component 202, and optionally, an extension 302. The configuration and materials forming the interface components, the limit components, and any optional extensions or side extension may be the same or different in each of the patches or portions of the limit collar 200. The configuration and materials forming the interface components, the limit components, and any optional extensions or side extension may incorporate any of the various features shown herein, including but not limited to the features shown in FIGS. 2-6. The plurality of limit collar portions may have one or more slots or channels 702 between adjacent portions, allowing for the passage of a fluid during conveyance and/or operation within a wellbore operating environment. The number and arrangement of limit collar 200 portions may be configured to provide for a desired slot or channel 702 flow area, thereby allowing for a desired flowrate of fluid through one or more slots or channels 702.

In an embodiment shown in FIG. 7B, the limit collar may comprise an interface component 704 that extends around the perimeter of the wellbore tubular 206 while leaving a single slot or channel 710. In this embodiment, the interface component 704 may be configured as a C-ring design to allow the interface component 704, and optionally one or more associated extensions 302, to be disposed about the wellbore tubular 206 without having to pass over an end of the wellbore tubular 206 (e.g., in a C-clamp, clamshell, or snap-ring fashion). This may allow for the application of the limit collar 200 to a wellbore tubular 206 without having to disassemble a wellbore tubular string to provide access to a wellbore tubular 206 end.

In an embodiment shown in FIG. 7C, the limit collar 200 may be constructed using a plurality of portions, and each portion may be oriented at an angle relative to the longitudinal axis of the wellbore tubular 206 on the surface of the wellbore tubular 206. For example, the limit collar 200 portions may be arranged in a helical or angled pattern and provide helical or angled flow paths 708 between adjacent limit collar 200 portions.

Figure 7D:
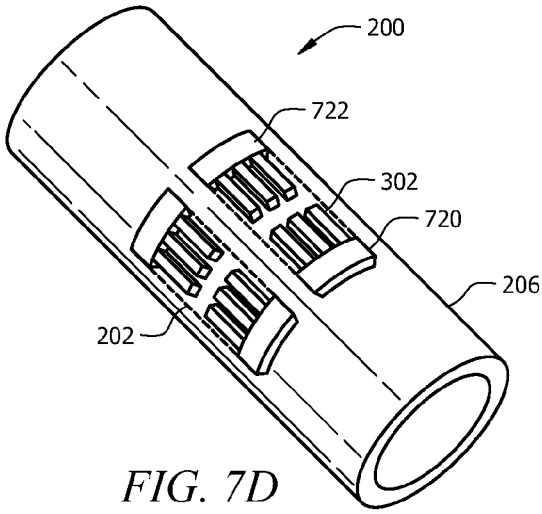

In an embodiment shown in FIG. 7D, the limit collar 200 may be constructed using a plurality of portions, and each portion may comprise a plurality of interface components 720, 722. The interface components 720, 722 may optionally have one or more extensions 302, which may overlap, engage, or form an integral component engaging both interface components 720, 722. The limit component 202 may be disposed about the plurality of interface components 720, 722 and optional extension 302. This embodiment may be used to retain one or more components on the wellbore tubular 206. For example, the limit collar 200 comprising a plurality of interface components 720, 722 may be used to retain a plurality of centralizers using a single limit collar 200.

In an embodiment, the embodiment shown in FIG. 7D may be used to form an integral centralizer on the wellbore tubular 206, where the interface components may serve to guide the wellbore tubular 206 through the wellbore while reducing the point loading on the limit collar 200 upon interacting with a portion of the wellbore (e.g., a close-tolerance restriction, an upset on the interior wellbore or tubular wall, etc.). The use of one or more patches may allow for fluid to flow around the integral centralizer during circulation of fluids in the annulus and/or during conveyance of the wellbore tubular 206 in the wellbore. To aid in guiding the limit collar 200 comprising a plurality of interface components 720, 722 through the wellbore, one or more ends of the interface components may be tapered, angled, or otherwise shaped to aid in guiding the limit collar 200 disposed on the wellbore tubular 206 through the wellbore.

Figure 8:
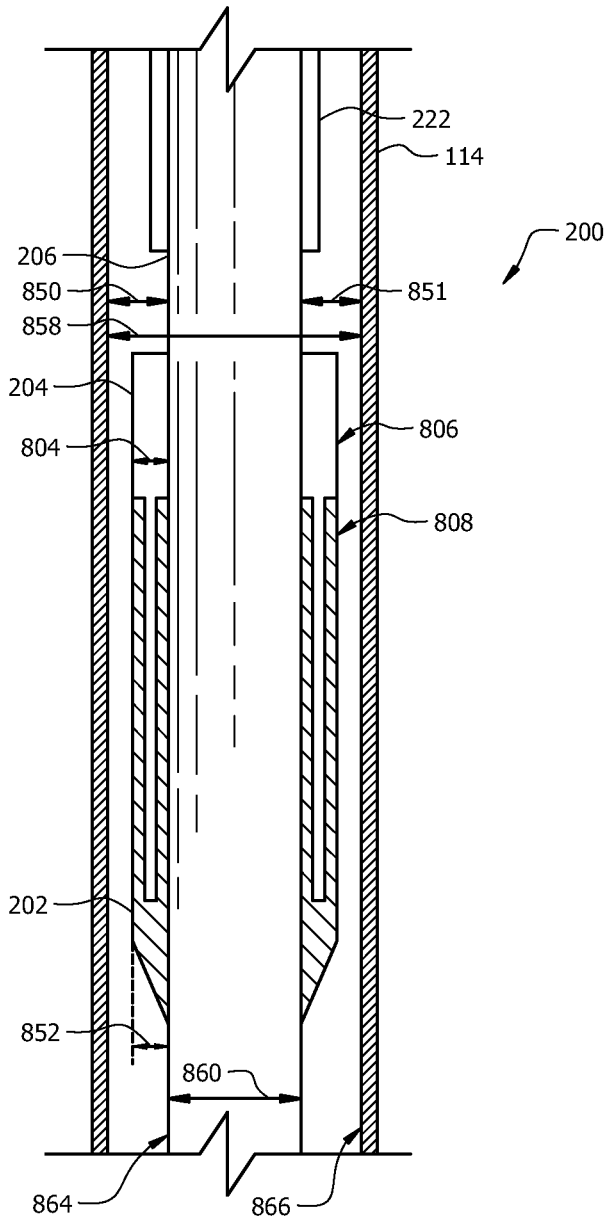
FIG. 8 is a cross-sectional view of a limit collar disposed within a wellbore according to an embodiment.

As shown in FIG. 8, the limit collar 200 described herein may be used in a wellbore comprising one or more close tolerance restrictions. A close tolerance restriction generally refers to a restriction in which the inner diameter 858 of the restriction passage is near the outer diameter 860 of a wellbore tubular 206, a tool, or other wellbore apparatus passing through the restriction. The close tolerance restrictions may result from various wellbore designs such as decreasing diameter casing strings, underreamed sections within a wellbore or collapsed wellbores or casings. For example, passing a smaller diameter casing 206 through a larger diameter casing can create a close tolerance restriction between the outer surface 864 of the smaller diameter casing 206 and the inner surface 866 of the larger diameter casing. Examples of casing sizes that may result in close tolerance restrictions within a wellbore 114 are shown in Table 1.

TABLE 1

Close Tolerance Restrictions
Casing Examples

| Smaller Diameter Casing Size (inches) | Passing through | Larger Diameter Casing Size (inches) |
|---|---|---|
| 3.5 | | 4.5 |
| 4.5 | | 5.5 |
| 5 | | 6 |
| 5.5 | | 6 |
| 6.625 | | 7 |
| 7 | | 8.5 |
| 7.625 | | 8.625 |
| 7.75 | | 8.5 |
| 9.625 | | 10.625 |
| 9.875 | | 10.625 |
| 10.75 | | 12 |
| 11.875 | | 13.375 |
| 13.375 | | 14.75 |
| 16 | | 17 |
| 20 | | 22 |

The designation of a restriction in a wellbore 114 as a close tolerance restriction may vary depending on a number of factors including, but not limited to, the tolerances allowed in the wellbore, the tortuosity of the wellbore, the need to use flush or near flush connections, the weight of the casing used in the wellbore, the presence of fluid and/or solids in the wellbore, etc. The tolerances allowed in the wellbore may vary from wellbore to wellbore. The term "annular diameter difference" may be used herein to characterize the tolerances in the wellbore 114 and refers to the total width of the annulus (i.e., the sum of annular width 850 and annular width 851) in the close tolerance restriction. The annular diameter difference is calculated as the difference between the inner diameter 858 of the restriction passage and the outer diameter 860 of the wellbore tubular 206 passing through the restriction. In an embodiment, a close tolerance restriction may have an annular diameter difference of about 0.125 inches, about 0.2 inches, about 0.3 inches, about 0.4 inches, about 0.5 inches, about 0.6 inches, about 0.7 inches, about 0.8 inches, about 0.9 inches, about 1.0 inch, about 1.1 inches, about 1.2 inches, about 1.3 inches, about 1.4 inches, or about 1.5 inches. While an upper limit of about 1.5 inches is used, the upper limit may be greater or less than 1.5 inches depending on the other considerations and factors (including for example, a risk/safety factor) for determining if a close tolerance restriction is present in a wellbore. The tortuosity of the wellbore refers to the deviation of the wellbore from a straight hole. A restriction in a wellbore is more likely to be considered a close tolerance restriction as the tortuosity of the wellbore increases. Further, a wellbore tubular with a flush or near flush connection refers to wellbore tubulars without or with only insubstantial upsets along the outer surface, for example at the connections between joints of the wellbore tubulars. The use of flush or near flush connections may create close tolerance restrictions along greater portions of the wellbore tubulars. Finally, the weight of the wellbore tubular may affect both the flexibility of the wellbore tubular string and the annular diameter difference between the wellbore wall or the inner surface 866 of a larger diameter casing string, depending on whether the wellbore 114 has been cased, and the outer surface 864 of a smaller diameter casing string 206. The use of premium grade casing and/or premium grade connections may indicate that the difference between inner and outer pipe diameters is small and indicate that a close tolerance restriction exists within the wellbore 114.

As shown in FIG. 8, the height 852 of the limit component 202 and/or the height 804 of the interface component 204 may vary depending on the width of the annulus available between the wellbore tubular 206 and the side of the wellbore or the inner surface 866 of the casing, depending on whether or not the wellbore has been cased. Due to the tolerances available within a wellbore, a well operator may specify a minimum tolerance for the space between the outermost surface (e.g., the surface 806 and/or surface 808 with the largest diameter) of a wellbore tubular 206, including the limit collar 200, and the inner surface 866 of the wellbore or the casing disposed within the wellbore. Using the tolerance, the height 852 of the limit component 202 and/or the height 804 of the interface component 204 may be less than the annular diameter difference minus the tolerance set by the well operator. In an embodiment, the tolerance may be about 0.1 inches to about 0.2 inches. In an embodiment, no tolerance may be allowed other than the pipe manufacturer's tolerances, which may be based on industry standards (e.g., American Petroleum Institute (API) standards applicable to the production of a wellbore tubular) of about 1% based on the outer diameter of the wellbore tubular 206 and the drift tolerance of the inner diameter of the close tolerance restriction present in the wellbore (e.g., a casing through which the wellbore tubular comprising the centralizer passes). The minimum height of the limit component 202 and the interface component 204 may be determined based on the structural and mechanical properties of the limit component 202, the interface component 204, the component 222 being retained on the wellbore tubular 206, and the desired retaining force of the limit collar 200. The height of each of the interface component 204, the limit component 202, and the component 222 retained on the wellbore tubular 206 may the same or different. The height of the limit component 202 and the interface component 204 may generally be similar to allow for a sufficient surface area for the transfer of an applied force between the interface component 204 and the limit component 202. In an embodiment, the height of the component 222 may be less than the height 804 of the interface component 204 to allow the limit component 202 and the interface component 204 to act as a guide for the component 222 during conveyance of the component 222 through the wellbore.

Figure 3:
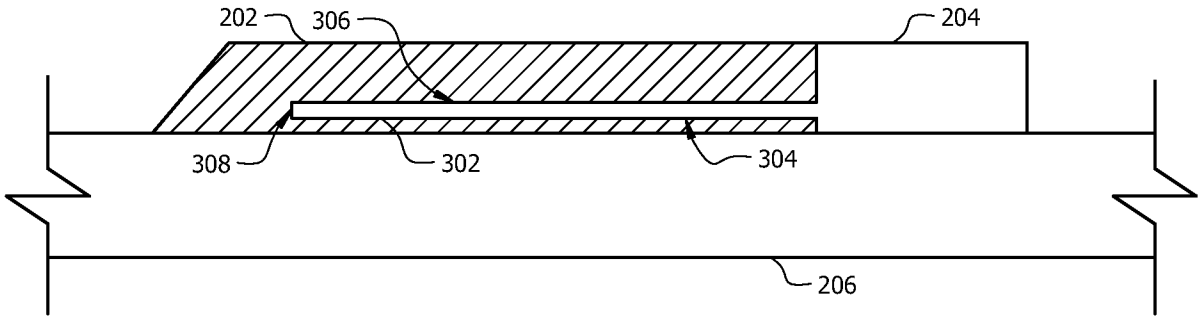
FIG. 3 is cross-sectional view of a limit collar according to another embodiment.

With reference to FIG. 2, the limit collar 200 may be disposed on the wellbore tubular 206 using a variety of methods. In an embodiment, the method used to dispose the limit collar 200 on the wellbore tubular 206 may depend, at least in part, on the material or materials used to form the limit component 202 and the interface component 204. The interface component 204 may be formed from any suitable materials as described herein. One or more extensions (as shown in FIG. 3), which may optionally comprise one or more side extensions and/or one or more surface features, may optionally be integrally formed with the interface component 204. In an embodiment, the one or more extensions 302 may be separately formed from the interface component 204 and optionally engage the interface component 204.

The interface component 204 may then be disposed on or about the wellbore tubular 206. In an embodiment in which the interface component 204 extends around the entire perimeter of the wellbore tubular 206, the interface component may be passed over an end of the wellbore tubular 206, for example before the wellbore tubular 206 is configured into a wellbore tubular string. In an embodiment, a split ring (e.g., a C-ring) design may be used with the interface component 204 to allow the interface component 204 to be disposed about the wellbore tubular 206 without passing the interface component over an end of the wellbore tubular 206. In an embodiment in which the limit collar 200 does not extend around the entire perimeter of the wellbore tubular 206, the interface component may be disposed directly on the wellbore tubular 206.

The interface component 204 may be disposed on the wellbore tubular before, during, or after application of the limit component or any portion thereof. For example, when a limit collar 200 comprises an extension 320 with one surface in contact with the wellbore tubular 206, the interface component comprising the extension 320 may be disposed on or about the wellbore tubular 206 prior to the application of the limit component 202, where the application of the limit component 202 may engage, couple, and/or bond the limit component to the wellbore tubular 206 and/or the interface component 204. As another example, when the limit collar 200 comprises an extension 302 with one surface on the outermost surface of the limit component 202, the limit component 202 or a portion thereof may be applied prior to disposing the interface component 204 comprising the extension 302 on or about the wellbore tubular 206 comprising the limit component 202. As still another example, when the limit collar 200 comprises an extension 302 with at least two surfaces in contact with the limit component 202, the interface component 204 comprising the extension 302 may be disposed about the wellbore tubular 206 prior to the application of the limit component 202. The limit component may then be formed around the extension 302 using, for example, a flowable limit component. Alternatively, the interface component 204 comprising the extension 302 may be disposed about the wellbore tubular 206 after the application of a first portion of the limit component 202 and prior to the application of a second portion of the limit component 202.

The limit component 202 may be applied using a variety of methods to allow the limit component to engage, couple, and/or bond to the wellbore tubular 206 and/or the interface component 204. When the limit component comprises a composite, a ceramic, a resin, an epoxy, and/or a polymer, the material or materials forming the limit component 202 may be fluids that may be provided prior to injection and/or molding. In an embodiment, the limit component material or materials may be provided as separate two-part raw material components for admixing during injection and/or molding and whereby the whole can be reacted. The reaction may be catalytically controlled such that the various components in the separated two parts of the composite material will not react until they are brought together under suitable injection and/or molding conditions. Thus, one part of the two-part raw material may include an activator, initiator, and/or catalytic component required to promote, initiate, and/or facilitate the reaction of the whole mixed composition. In some embodiments, the appropriate balance of components may be achieved in a mold by use of pre-calibrated mixing and dosing equipment.

In an embodiment, the limit collar 200 may be applied directly on the wellbore tubular 206 through the use of a mold. In this process, the surface of the wellbore tubular 206 and/or the interface component 204 with an optional extension 302 may be optionally prepared using any known technique to clean and/or provide a suitable surface for bonding the limit component 202 material to the wellbore tubular 206. In an embodiment, the surface of the wellbore tubular 206 and/or the interface component 204 may be metallic. The attachment surface may be prepared by sanding, sand blasting, bead blasting, chemically treating the surface, heat treating the surface, or any other treatment process to produce a clean surface for applying the limit component to the wellbore tubular 206 and/or the interface component 204. In an embodiment, the preparation process may result in the formation of one or more surface features such as corrugation, stippling, or otherwise roughening of the surface, on a microscopic or macroscopic scale, to provide an increased surface area and suitable surface features to improve bonding between the surface and the limit component 202 material or materials.

The optionally prepared surface may then be covered with an injection mold. The injection mold may be suitably configured to retain the interface component 204 in the desired position and provide the shape of the limit component 202 with an appropriate height. The injection mold may be provided with an adhesive on a surface of the mold that contacts the wellbore tubular 206 and/or the interface component 204. It will be appreciated that the adhesive described in this disclosure may comprise any suitable material or device, including, but not limited to, tapes, glues, and/or hardenable materials such as room temperature vulcanizing silicone. The injection mold may be sealed against the prepared surface. Following such general sealing against the prepared surface, the limit component 202 material or materials described herein may be introduced into a space between the injection mold and the prepare surface using a port disposed in the injection mold. The limit component 202 material or materials may flow throughout the mold and form the limit component 202 on the surface of the wellbore tubular 206.

The limit component 202 material or materials may be allowed to harden and/or set. For example, heat may be applied to thermally activate a thermally setting resin, or allowing a sufficient amount of time for the curing of the limit component 202 material or materials. After the limit component 202 material or materials has sufficiently hardened and/or set, the injection mold may be unsealed from the wellbore tubular 206 and/or the interface component 204. In an embodiment, a plurality of limit component 202 materials may be used with multiple injection periods to produce a desired limit component 202 structure and/or composition.

When the limit component 202 comprises a polymer, the material or materials forming the limit component 202 may be provided in the form of a tape wrap, sleeve, sheet, fiber, and/or a fibrous material that can be disposed about the wellbore tubular 206. In an embodiment, the limit collar 200 may be applied directly to the wellbore tubular 206. In this process, the surface of the wellbore tubular 206 and/or the interface component 204 with an optional extension 302 may optionally be prepared using any known technique to clean and/or provide a suitable surface for bonding the limit component 202 material to the wellbore tubular 206 as described above. The preparation process may result in the formation of one or more surface features such as corrugation, stippling, or otherwise roughening of the surface, on a microscopic or macroscopic scale, to provide an increased surface area and suitable surface features to improve bonding between the surface and the limit component 202 material or materials.

In an embodiment, the interface component 204 may be disposed in position on the wellbore tubular and the limit component 202 comprising the polymer may be disposed about the interface component, which may comprise an optional extension 302. When a sleeve of polymer is used, the sleeve may be passed over an end of the wellbore tubular and positioned relative to the wellbore tubular. When the polymer is in the form of a tape, sheet, or fiber, the polymer may be wrapped or otherwise disposed about the wellbore tubular 206 and/or the interface component 204. In an embodiment, a layer of the limit component 202 may be disposed about the wellbore tubular 206 prior to the placement of the interface component 204, which may be followed by a second layer of the limit component 202.

The limit component comprising a polymer may shrink in response to the application of heat. In an exemplary method, a gas torch, heat gun, or other source of heat may be moved around the circumference of the wellbore tubular 206 to apply heat to all exposed exterior surfaces of the polymer material. The limit component 202 material may then conform to the exposed portions of the wellbore tubular 206 and/or the interface component 204 in response to the application of the heat, thereby forming the limit collar 200.

When the limit component 202 comprises one or more metals, alloys, and/or a matrix phase comprising one or more metals and/or alloys, the material or materials forming the limit component 202 may be disposed about the wellbore tubular 206 using any type of application process known for metals, alloys, and/or matrix materials. In an embodiment, the limit collar 200 may be applied directly to the wellbore tubular 206 using a thermal spraying process. In this process, the surface of the wellbore tubular 206 and/or the interface component 204 with an optional extension 302 may optionally be prepared using any known technique to clean and/or provide a suitable surface for bonding the limit component 202 material to the wellbore tubular 206 as described above. The preparation process may result in the formation of one or more surface features such as corrugation, stippling, or otherwise roughening of the surface, on a microscopic or macroscopic scale, to provide an increased surface area and suitable surface features to improve bonding between the surface and the limit component 202 material or materials.

In an embodiment, the interface component 204 may be disposed in position on the wellbore tubular and the limit component 202 comprising the polymer may be disposed about the interface component, which may comprise an option extension 302. The limit component may then be applied to the wellbore tubular 206 and the interface component 204. In an embodiment, a layer of the limit component may be applied to the wellbore tubular prior to the placement of the interface component, which may be followed by the application of another layer of the limit component.

In an embodiment, the limit component comprising one or more metals, alloys, and/or a matrix phase comprising one or more metals and/or alloys may be applied using a thermal spray process. One type of thermal spraying system may comprise a twin wire system. A twin wire system utilizes a first wire and a second wire with a voltage applied between the wires. In an embodiment, the first wire and the second wire may be of the same or similar design (e.g., solid or tubular, about the same diameter, etc.), and may have the same or different chemical compositions. In an embodiment, the first wire may comprise a first composition, while the second wire may comprise the same or a complementary composition to the first composition to yield a desired limit component 202 on the wellbore tubular 206. When the voltage is applied to the wires, the proximity of the wire ends may create an arc between the ends and cause the wires to melt. A compressed air source may be used to atomize the resulting molten metal caused by the arcing into fine droplets and propel them at high velocity toward the wellbore tubular 206 and/or the interface component 204. The twin wire spraying process may use commercially available equipment, such as torches, wire feeding systems, and power sources. Other thermal spraying processes may be used to achieve the deposition of the limit component 202 material or materials on the wellbore tubular 206 and/or the interface component 204. The deposition and cooling of the droplets may result in the build up of the limit component material or materials on the wellbore tubular 206 and/or the interface component 204. The materials may be deposited until a desired limit component 202 is formed on the wellbore tubular 206. In an embodiment, some post processing of the limit component 202 may be performed to produce a smooth surface and/or a desired finish.

Figure 9:
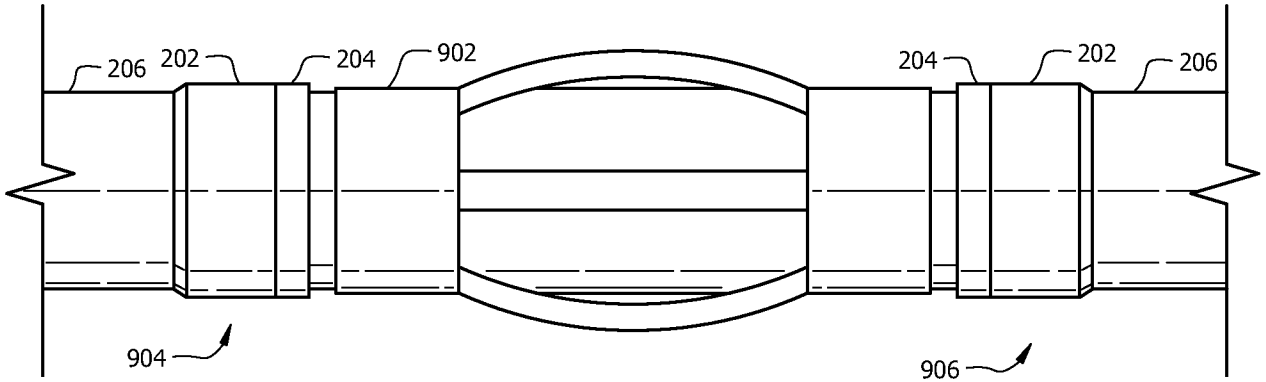
FIG. 9 is a plan view of a limit collar according to an embodiment.

As shown in FIG. 9, a wellbore tubular 206 comprising a limit collar 904 retaining a component 902 may be provided using one or more of the limit collars 904, 906 described herein. In an embodiment, the component 902 retained on the wellbore tubular 206 may comprise any number of components including, but not limited to, a centralizer, a packer, a cement basket, various cement assurance tools, testing tools, and the like. In an embodiment, the component 902 may comprise a centralizer of the type disclosed in U.S. patent application Ser. No. 13/013,259, entitled "Composite Bow Centralizer" by Lively et al. and filed on Jan. 25, 2011, which is incorporated herein by reference in its entirety. The component 902 may be slidingly engaged with the wellbore tubular 206 to allow for movement relative to the wellbore tubular 206. The component 902 may be retained on the wellbore tubular 206 by forming a limit collar 904 using any of the methods described herein, followed by disposing one or more components 902 about the wellbore tubular 206. The component 902 may be configured to move relative to the wellbore tubular 206 while being retained when the component 902 engages the limit collar 904. One or more additional limit collars 906 may be formed using any of the methods described herein, thereby retaining the component 902 on the wellbore tubular 206 between the two limit collars 904, 906. Once formed, the wellbore tubular 206 comprising at least one limit collar 904 and the component 902 to be retained on the wellbore tubular 206 may be placed within a wellbore.

In an embodiment, a plurality of components retained by a plurality of limit collars according to the present disclosure may be used with one or more wellbore tubular sections. A wellbore tubular string refers to a plurality of wellbore tubular sections connected together for conveyance within the wellbore. For example, the wellbore tubular string may comprise a casing string conveyed within the wellbore for cementing. The wellbore casing string may pass through the wellbore prior to the first casing string being cemented, or the casing string may pass through one or more casing strings that have been cemented in place within the wellbore. In an embodiment, the wellbore tubular string may comprise premium connections, flush connections, and/or nearly flush connections. One or more close tolerance restrictions may be encountered as the wellbore tubular string passes through the wellbore or the casing strings cemented in place within the wellbore. A plurality of limit collars as described herein may be used on the wellbore tubular string to maintain one or more components (e.g., a centralizer or a plurality of centralizers) on the wellbore tubular string as it is conveyed within the wellbore. The number of limit collars and their respective spacing along a wellbore tubular string may be determined based on a number of considerations including the properties of each component being retained on the wellbore tubular, the properties of the wellbore tubular (e.g., the sizing, the weight, etc.), and the properties of the wellbore through which the wellbore tubular is passing (e.g., the annular diameter difference, the tortuosity, the orientation of the wellbore, etc.). In an embodiment, a wellbore design program may be used to determine the number and type of the limit collars and components retained on the wellbore tubular string based on the various inputs as described herein. The number and spacing of the limit collars and components retained by the limit collars along the wellbore tubular may vary along the length of the wellbore tubular based on the expected conditions within the wellbore. In an embodiment, the wellbore may comprise at least one close tolerance restriction within the wellbore.

As described herein, the limit collar may be used with a wellbore tubular disposed within a wellbore in a subterranean formation. The limit collar described herein may be coupled to a wellbore tubular through the use of a limit component rather than set screws. The use of the limit component may allow the limit collar to have a lower height than required for set screws, which may allow the limit collar to be used in close tolerance wellbores. The use of an interface component may prevent point loading on the limit component, reducing the potential for failure of the limit collar associated with point loading scenarios. The use of an extension may further strengthen the limit collar and allow the load to be more evenly distributed from the interface component across the limit component. Further, the use of a side extension and/or surface feature may allow the interface component to more readily support both compression and tensile loads. Further, the limit collar of the present disclosure may be quickly installed on existing tubing and may not require dedicated subs for their use. The limit collar may be installed by forming the limit collar directly on a wellbore tubular, such as an existing section of casing. This production method may allow the limit collar to be installed at the well site or within the oilfield rather than requiring a dedicated manufacturing facility and dedicated subs for attaching the limit collar to a wellbore tubular string.

The use of the limit collar disclosed herein comprising a plurality of portions or patches may provide one or more slots or flow channels, thereby allowing fluid to flow past the limit collar. This configuration may aid in the circulation of fluids in an annulus created between the wellbore tubular and an outer wellbore tubular or the wellbore wall. When used to retain a centralizer on a casing string during a cementing operation, the system may allow for proper mud displacement with cement, reducing the likelihood of channeling and incomplete cementing. Traditional stop collars using set screws extend around the entire perimeter of the wellbore tubular, reducing fluid flow in the annulus and potentially allowing for channeling and incomplete displacement of drilling fluids (e.g., drilling mud). The channeling may result in the migration of hydrocarbons through the channels during the life of the wellbore. The improved fluid flow around the wellbore tubular due to the slots or flow channels may represent an advantage of the present limit collar as compared to traditional stop collars extending around the entire wellbore tubular and retained by set screws.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A limit collar comprising:

a limit component coupled to a surface of a wellbore tubular; and an interface component engaging the limit component, wherein the interface component comprises a material with a compressive strength greater than that of a material used to form the limit component.

2. The limit collar of claim 1, wherein an edge of the limit component is tapered.

3. The limit collar of claim 1, wherein the interface component comprises at least one material selected from the group consisting of: a metal, an alloy, a composite, a ceramic, and any combination thereof.

4. The limit collar of claim 1, wherein the interface component comprises an extension, and wherein at least one surface of the extension is coupled to the limit component.

5. The limit collar of claim 4, wherein the extension comprises a side extension.

6. The limit collar of claim 4, wherein the extension comprises a longitudinal extension or a fibrous material.

7. The limit collar of claim 4, wherein the extension comprises a surface feature selected from the group consisting of: a protrusion, a recess, a surface corrugation, a surface stippling, and a surface roughening.

8. The limit collar of claim 1, further comprising a plurality of interface components engaging the limit component.

9. A limit collar comprising:

a limit component coupled to a surface of a wellbore tubular; and an interface component engaging the limit component, wherein the limit collar comprises a plurality of portions, and wherein each portion does not extend around the perimeter of the wellbore tubular.

10. The limit collar of claim 9, further comprising one or more slots formed between adjacent portions.

11. A method comprising:

providing a limit collar disposed on a wellbore tubular and a first component slidingly engaged on the wellbore tubular, wherein the limit collar comprises:

a limit component coupled to a surface of the wellbore tubular; and an interface component engaging the limit component, wherein the interface component comprises a material with a compressive strength greater than that of a material used to form the limit component; and conveying the wellbore tubular within a wellbore, wherein the first component is retained on the wellbore tubular due to the engagement of the first component with the interface component.

12. The method of claim 11, wherein the limit component comprises a material selected from the group consisting of: a composite, a ceramic, a resin, an epoxy, a polymer, a metal, an alloy, or any combination thereof.

13. The method of claim 11, wherein the limit component comprises a metal, and wherein the metal is selected from the group consisting of: iron, chromium, nickel, molybdenum, tungsten, titanium, niobium, manganese, silicon, vanadium, combinations thereof, and alloys thereof.

14. The method of claim 11, wherein the interface component comprises an extension that comprises a shear force transfer surface, and a compressive load transfer surface.

15. The method of claim 11, wherein the interface component comprises an extension that comprises a shear force transfer surface, a compressive load transfer surface, and a tensile load transfer surface.

16. The method of claim 11, wherein the interface component comprises an extension that comprises a total load transfer surface area, wherein a first portion of the total load transfer surface area comprises a compressive load transfer surface, and wherein a second portion of the total surface area comprises a shear load transfer surface.

17. The method of claim 11, wherein the limit collar further comprises a plurality of interface components engaging the limit component.

18. The method of claim 11, wherein the limit collar comprises a plurality of portions, and wherein each portion does not extend around the perimeter of the wellbore tubular.

19. The method of claim 18, further comprising one or more slots formed between adjacent portions.

20. A method comprising:

providing a limit collar disposed on a wellbore tubular and a first component slidingly engaged on the wellbore tubular, wherein the limit collar comprises:

a limit component coupled to a surface of the wellbore tubular, wherein the limit component comprises a polymer, and wherein the polymer comprises a cross-linked polymer, a polyolefin, a cross-linked polyolefin, or any combination thereof, and an interface component engaging the limit component; and conveying the wellbore tubular within a wellbore, wherein the first component is retained on the wellbore tubular due to the engagement of the first component with the interface component.

21. A method comprising:

providing a wellbore tubular; and forming a limit collar on a first surface portion of the wellbore tubular, wherein the limit collar comprises:

a limit component coupled to the first surface portion of the wellbore tubular; and an interface component engaging the limit component, wherein forming a limit collar on the first surface portion comprises:

disposing a mold about the interface component and the first surface portion; and injecting a composite material into a space between the mold and the first surface portion to form the limit component.

22. A method comprising:

providing a wellbore tubular; and forming a limit collar on a first surface portion of the wellbore tubular, wherein the limit collar comprises:

a limit component coupled to the first surface portion of the wellbore tubular; and an interface component engaging the limit component, wherein forming a limit collar on the first surface portion comprises:

disposing a polymer material about the interface component and the first surface portion; and shrinking the polymer material to form the limit collar by applying heat to the polymer.

23. A method comprising:

providing a wellbore tubular; and forming a limit collar on a first surface portion of the wellbore tubular, wherein the limit collar comprises:

a limit component coupled to the first surface portion of the wellbore tubular; and an interface component engaging the limit component, wherein forming a limit collar on the first surface portion comprises:

thermally spraying a composition comprising a metal onto the first surface portion and the interface component to form the limit collar.

* * * * *